US005484367A

United States Patent [19]

Martinez

[11] Patent Number: 5,484,367

[45] Date of Patent: Jan. 16, 1996

[54] WEIGHT SET HAVING MEANS TO PREVENT ROTATION OF THE WEIGHTS ON THE BAR

[76] Inventor: Ralph E. Martinez, 1961 W. Admiralty St., Colton, Calif. 92324-6624

[21] Appl. No.: 351,675

[22] Filed: Dec. 8, 1994

[51] Int. Cl.[6] ..... A63B 21/075

[52] U.S. Cl. ..... 482/107

[58] Field of Search ..... 482/50, 93, 106–109; 273/193 A

[56] References Cited

U.S. PATENT DOCUMENTS 3,463,486 8/1969 James, Jr. ..... 482/108 X
4,361,324 11/1982 Baroi ..... 482/108
4,768,780 9/1988 Hayes ..... 482/108
5,121,925 6/1992 Blundo ..... 482/109 X

*Primary Examiner*—Richard J. Apley
*Assistant Examiner*—John Mulcahy

[57] ABSTRACT

A toy weight set for simulating hand weight exercises by a child. The inventive device includes an elongated bar formed of a solid polymeric material. A plurality of circular weights formed of the solid polymeric material are coupled to opposed ends of the bar. The bar includes a pair of flanges equally spaced from its ends. The ends of the bar are threaded such that there are smooth areas between the threads and the flange on each end. A key projects from the smooth neck area. The weights have central apertures with corresponding keyways such that the weights fit over the smooth neck area of the bar. The key prevents the weights from rotating.

3 Claims, 4 Drawing Sheets

FIG. 3
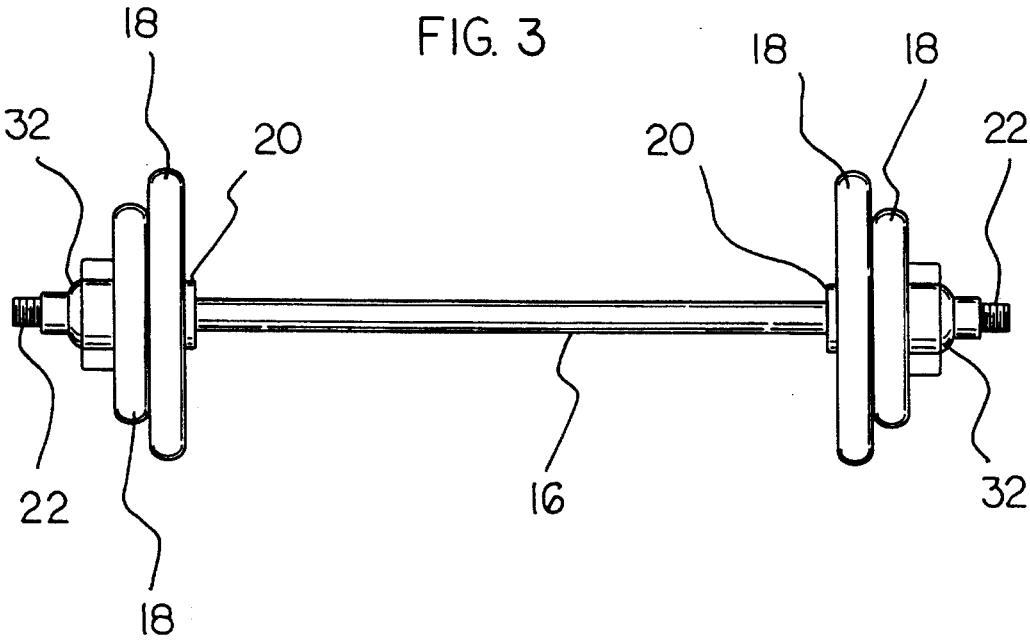
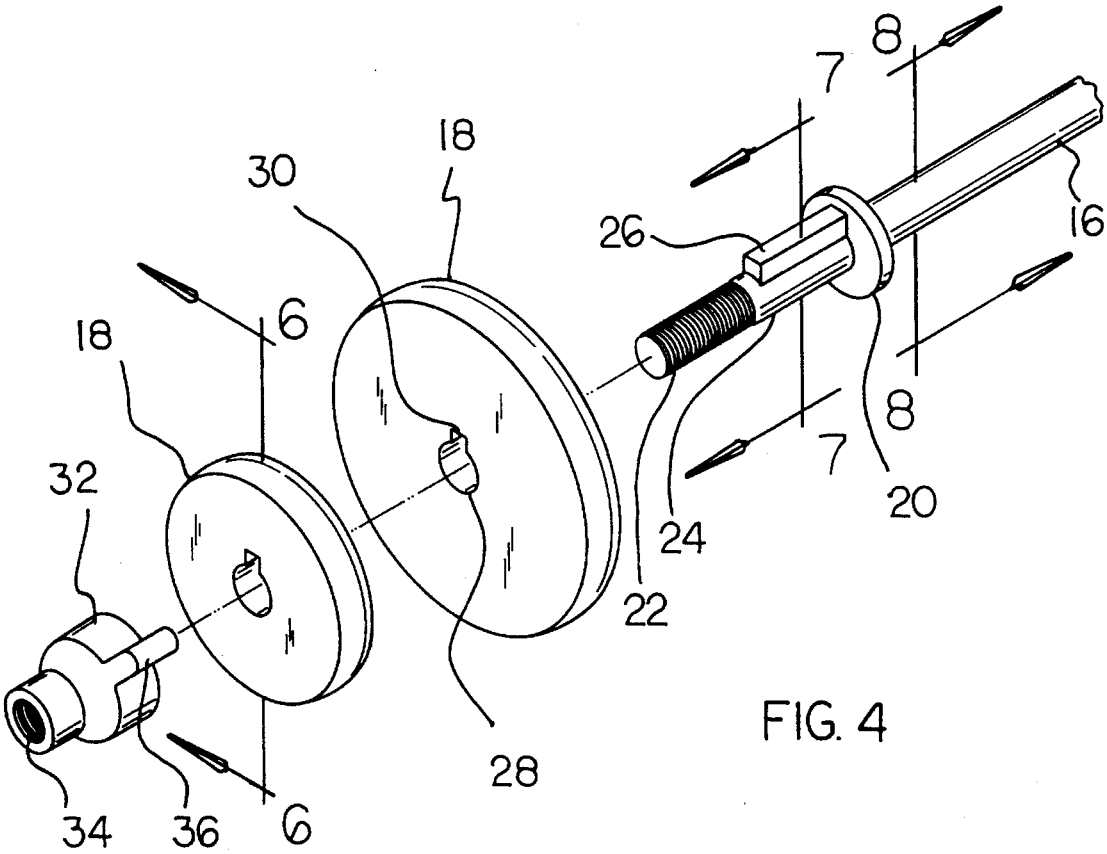
FIG. 4

FIG. 5
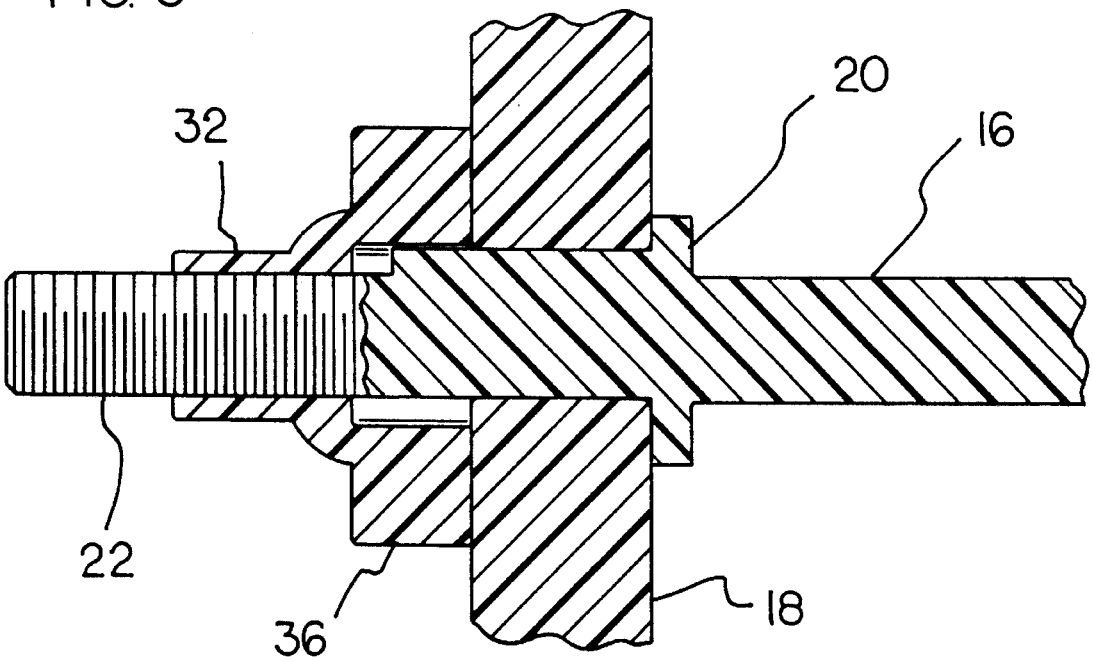
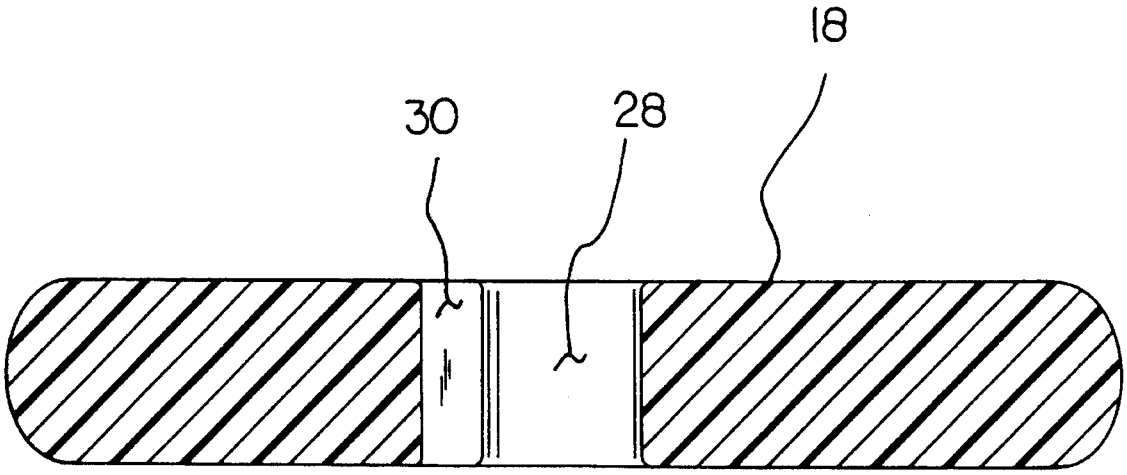
FIG. 6

WEIGHT SET HAVING MEANS TO PREVENT ROTATION OF THE WEIGHTS ON THE BAR

BACKGROUND OF THE INVENTION

1. Field of the Invention

The present invention relates to weight lifting equipments and more particularly pertains to a toy weight set for simulating hand weight exercises by a child.

2. Description of the Prior Art

The use of weight lifting equipments is known in the prior art. More specifically, weight lifting equipments heretofore devised and utilized are known to consist basically of familiar, expected and obvious structural configurations, notwithstanding the myriad of designs encompassed by the crowded prior art which have been developed for the fulfillment of countless objectives and requirements.

Known prior art weight lifting equipments include U.S. Pat. Nos. 4,913,422; 4,828,256; 4,103,887; 3,825,253; and 3,488,051.

While these devices fulfill their respective, particular objectives and requirements, the aforementioned patents do not disclose a toy weight set for simulating hand weight exercises which includes an elongated bar formed of a solid polymeric material, and a plurality of circular weights formed of the solid polymeric material and coupled to opposed ends of the bar, wherein a proportion of the Young's modulus and the density of the polymeric material is equal to that of steel so as to accurately simulate the bending characteristics of a steel barbell set.

In these respects, the toy weight set according to the present invention substantially departs from the conventional concepts and designs of the prior art, and in so doing provides an apparatus primarily developed for the purpose of simulating hand weight exercises by a child.

SUMMARY OF THE INVENTION

In view of the foregoing disadvantages inherent in the known types of weight lifting equipments now present in the prior art, the present invention provides a new toy weight set construction wherein the same can be utilized for simulating hand weight exercises by a child. As such, the general purpose of the present invention, which will be described subsequently in greater detail, is to provide a new toy weight set apparatus and method which has many of the advantages of the weight lifting equipments mentioned heretofore and many novel features that result in a toy weight set which is not anticipated, rendered obvious, suggested, or even implied by any of the prior art weight lifting equipments, either alone or in any combination thereof.

To attain this, the present invention generally comprises a toy weight set for simulating hand weight exercises by a child. The inventive device includes an elongated bar formed of a solid polymeric material. A plurality of circular weights formed of the solid polymeric material are coupled to opposed ends of the bar. A proportion of the Young's modulus and the density of the polymeric material utilized in the construction of the elongated bar and weights is preferably equal to that of steel so as to accurately simulate the bending characteristics of a steel barbell set.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy weight set apparatus and method which has many of the advantages of the weight lifting equipments mentioned heretofore and many novel features that result in a toy weight set which is not anticipated, rendered obvious, suggested, or even implied by any of the prior art weight lifting equipments, either alone or in any combination thereof.

It is another object of the present invention to provide a new toy weight set which may be easily and efficiently manufactured and marketed.

It is a further object of the present invention to provide a new toy weight set which is of a durable and reliable construction.

An even further object of the present invention is to provide a new toy weight set which is susceptible of a low cost of manufacture with regard to both materials and labor, and which accordingly is then susceptible of low prices of sale to the consuming public, thereby making such toy weight sets economically available to the buying public.

Still yet another object of the present invention is to provide a new toy weight set which provides in the apparatuses and methods of the prior art some of the advantages thereof, while simultaneously overcoming some of the disadvantages normally associated therewith.

Still another object of the present invention is to provide a new toy weight set for simulating hand weight exercises by a child.

Yet another object of the present invention is to provide a new toy weight set which includes an elongated bar formed of a solid polymeric material, and a plurality of circular weights also formed of the solid polymeric material and coupled to opposed ends of the bar.

Even still another object of the present invention is to provide a new toy weight set of the aforementioned structure in which a proportion of the Young's modulus and the density of the polymeric material utilized in the construction of the elongated bar and weights is preferably equal to that of steel so as to accurately simulate the bending characteristics of a steel barbell set.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevation view of the invention as illustrated in FIG. 1.

FIG. 4 is an exploded isometric illustration of a portion of the invention.

FIG. 5 as a cross sectional view taken along line 5—5 of FIG. 1.

FIG. 6 is a cross sectional view taken along line 6—6 of FIG. 4.

DESCRIPTION OF THE PREFERRED EMBODIMENT

Figure 1:
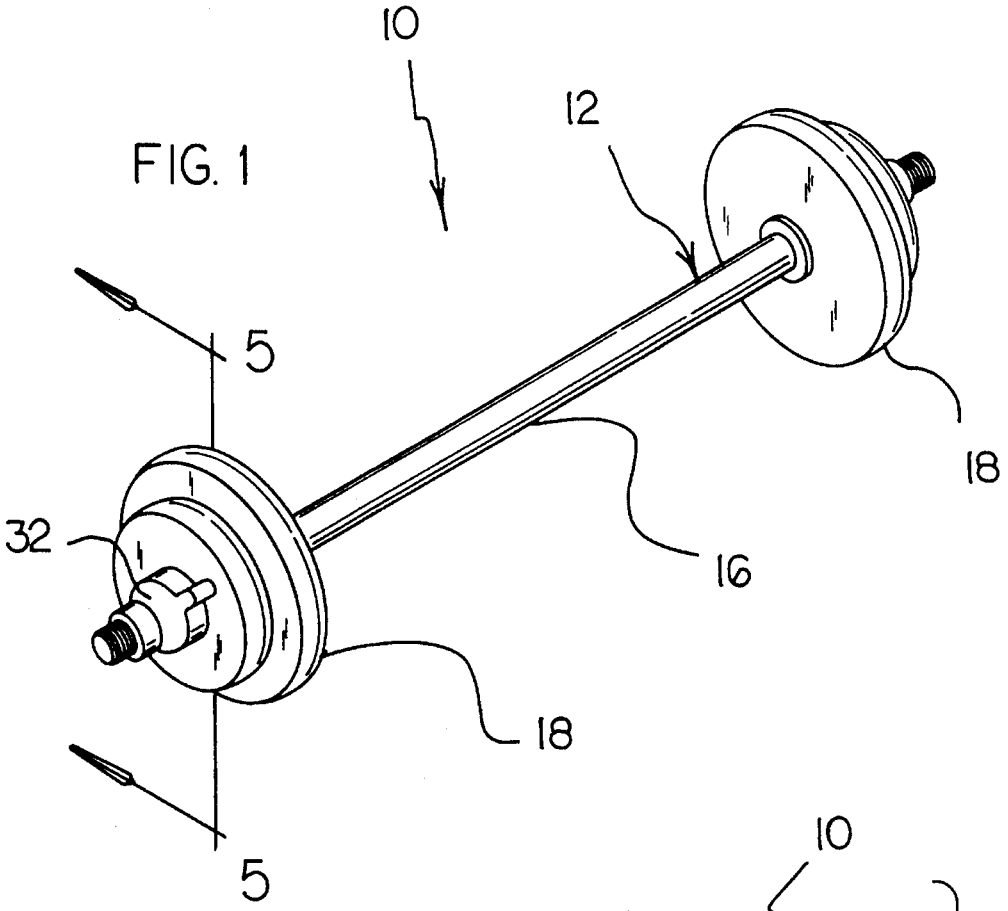
FIG. 1 is an isometric illustration of a toy weight set according to the present invention.

With reference now to the drawings, and in particular to FIGS. 1–8 thereof, a new toy weight set embodying the principles and concepts of the present invention and generally designated by the reference numeral 10 will be described.

Figure 2:
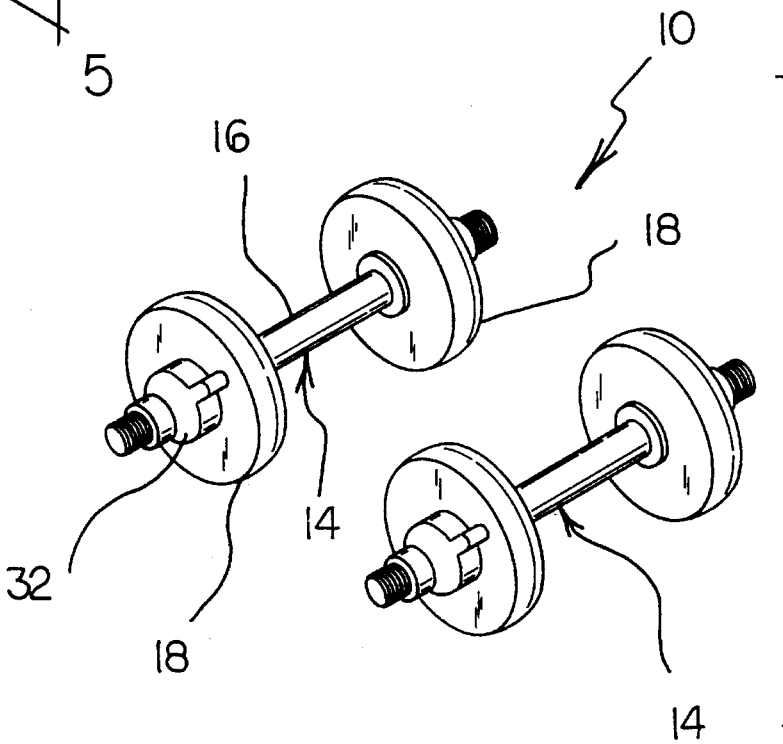
FIG. 2 is an isometric illustration of an alternative form of the present invention.

More specifically, it will be noted that the toy weight set 10 may take the form of either a barbell 12, as illustrated in FIG. 1, or a dumbbell 14, as shown in a pair in FIG. 2. The toy weight set 10 in either the barbell 12 or the dumbbell 14 form comprises an elongated bar 16 formed of a polymeric material. A plurality of weights 18, also formed of a polymeric material, are secured to opposed ends of the elongated bar 16, whereby an individual may grasp and manipulate the elongated bar 16 during a simulated exercise procedure.

As best illustrated in FIGS. 3 through 6, it can be shown that the elongated bar 16 includes a pair of spaced flanges 20 equally spaced from respectively opposed ends of the bar. The elongated bar 16 is shaped so as to define opposed threaded ends 22 continuing into a smooth neck area 24 intersecting the flange 20. A projecting key 26 extends substantially orthogonally from the smooth neck area 24 of the elongated bar 16. Each of the weights 18 is preferably circular in configuration and includes a through-extending center aperture 28 permitting direction of the threaded end 22 and smooth neck area 24 of one of the ends of the elongated bar 16 therethrough. The weights 18 each further include a key way 30 formed therein and positioned in contiguous communication with the center aperture 28 permitting a reception of the projecting key 26 through the key way. By this structure, the weighs 18 can be positioned over respectively opposed ends of the elongated bar 16, whereby the projecting key 26 serves to preclude rotation of the weight 18 relative to the elongated bar 16.

To secure the weights 18 to the elongated bar 16 a retaining collar 32 includes interior threads 34 cooperable with the threaded ends 22 of the bar. The retaining collar 32 preferably includes at least one projecting lever 36 extending therefrom for facilitating manual rotation of the retaining collar during coupling thereof to the threaded end 22 of the elongated bar 16.

Figure 7:
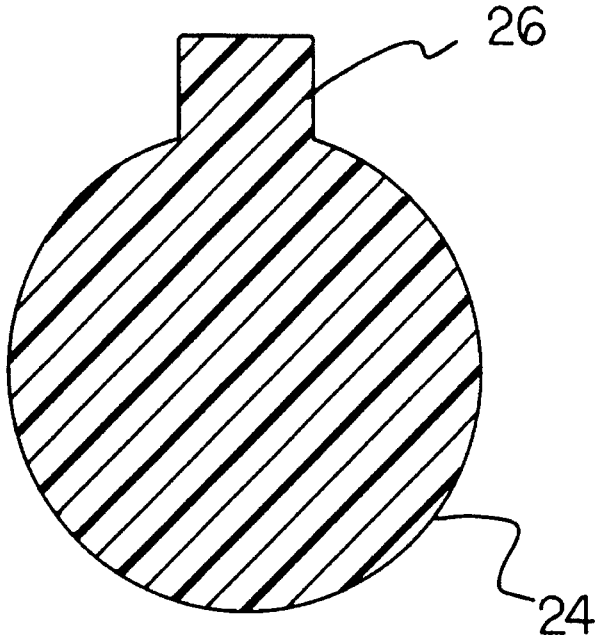
FIG. 7 is a cross sectional view taken along line 7—7 of FIG. 4.
Figure 8:
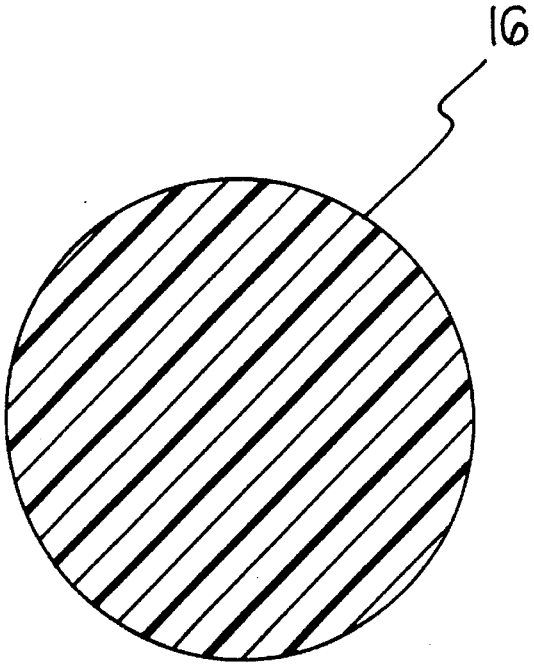
FIG. 8 is a cross sectional view taken along line 8—8 of FIG. 4.

As shown in FIGS. 7 and 8, the elongated bar 16 and the projecting key 26 are preferably integrally molded from the polymeric material. To this end, the flange 20 is also preferably integrally molded with the elongated bar 16 to reduce production costs of the device 10.

The polymeric material utilized in the construction of the device 10 preferably has a proportion of the Young's modulus and the density thereof equal to that of steel so as to accurately simulate the bending characteristics of a steel barbell set. To this end, a proportion of the Young's modulus and the density of steel is equal to approximately $2.5\times10^7$ Nm/Kg. Any polymeric material possessing this proportionate constant can be utilized in the construction of the device 10, or alternatively, small metallic or lead weights can be embedded within each of the weights 18 and/or within the elongated bar 16 to provided such ratio.

In use, the toy weight set 10 according to the present invention can be utilized by a child to simulate hand weight exercises. Because the device 10 is entirely constructed of a polymeric material, danger to the child through a dropping of the device 10 is substantially reduced. In other words, the toy weight set 10 in its entirety preferably does not weigh an amount sufficient to cause bodily damage to feet or other portions of the body upon which it may be dropped by a child.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy weight set comprising:

an elongated bar formed of a polymeric material shaped so as to define opposed threaded ends, the bar having a pair of spaced flanges equally spaced from the respectively opposed ends of the bar wherein the opposed threaded ends continue into a smooth neck area intersecting the flanges and wherein the bar is further shaped so as to define a projecting key extending substantially orthogonally from the smooth neck area; and, a plurality of weighs formed of a polymeric material wherein each of the weights is circular in configuration and includes a through-extending center aperture having a keyway corresponding to the key permitting direction of the threaded end and smooth neck area of one of the ends of the elongated bar therethrough such that the projecting key is received in the keyway.

2. The toy weight set of claim 1, and further comprising a pair of retaining collars including interior threads engaged with the threaded ends of the bar, the retaining collars each including at least one projecting lever extending therefrom for facilitating manual rotation of the retaining collar during coupling thereof to the threaded end of the elongated bar.

3. The toy weight set of claim 2, wherein the elongated bar, the projecting keys, and the flanges are integrally molded.

* * * * *